United States Patent [19]

Tanaka

[11] Patent Number: 5,074,696

[45] Date of Patent: Dec. 24, 1991

[54] BINDING FASTENER ASSEMBLY

[76] Inventor: William T. Tanaka, 1521 Dalmatia Dr., San Pedro, Calif. 90732

[21] Appl. No.: 550,063

[22] Filed: Jul. 9, 1990

[51] Int. Cl.[5] ..... B42F 3/02

[52] U.S. Cl. ..... 402/52; 411/339

[58] Field of Search ..... 402/52, 46, 48; 281/27.3; 411/339, 508

[56] References Cited

U.S. PATENT DOCUMENTS

| | | | |
|---|---|---|---|
| 2,201,551 | 5/1940 | Welk | 402/52 X |
| 2,560,110 | 7/1951 | Horn | 402/52 |
| 3,251,260 | 5/1966 | Serdechny | 402/52 X |
| 4,730,972 | 3/1988 | Sun et al. | 402/52 X |

*Primary Examiner*—Timothy V. Eley
*Assistant Examiner*—Willmon Fridie, Jr.
*Attorney, Agent, or Firm*—Leon Gilden

[57] ABSTRACT

A fastener structure for use and securement of sheet stacks is set forth, wherein the fasteners each include a semi-cylindrical shank formed with engagement ribs in confronting relationship relative to securing pairs of the fasteners. The ribs each include a horizontal floor, and wherein the fasteners are in an axially aligned relationship relative to one another to effect securement of a sheet stack utilizing spaced binder plates to secure the stack together.

1 Claim, 4 Drawing Sheets

PRIOR ART

BINDING FASTENER ASSEMBLY

BACKGROUND OF THE INVENTION

1. Field of the Invention

The field of invention relates to fastener structure, and more particularly pertains to a new and improved binding fastener assembly wherein the same is utilized to secure stacks of sheets together.

2. Description of the Prior Art

Fasteners of various types have been utilized in the prior art. Particularly in binding and securement of stacks of papers to effect a book-like arrangement, such binding fasteners as set forth by the instant invention effect a convenient and secure manner of binding sheets together in an expedient and rapid manner. Examples of prior art structure may be found in Enstrom U.S. Pat. No. 3,882,755 wherein a sheet metal fastener utilizes arms, each arm including serrated teeth for engaging a workpiece surface.

Chisholm, et al. U.S. Pat. No. 4,728,238 sets forth a one-piece drive fastener utilizing a shank and resilient wing elements mounted to the shank for securement within various work surfaces.

Patry U.S Pat. No. 4,003,175 sets forth a fastener arrangement utilizing a shank formed with a hardened forward tip and annular circumferentially arranged ribs formed about the shank.

Martin U.S. Pat. No. 3,764,446 sets forth a fastener structure wherein a nail-like member utilizes annular ribs receivable within a socket formed With complementary therewithin for reception of the fastener shank therewithin.

As such, it may be appreciated that there continues to be a need for a new and improved binding fastener assembly wherein the same addresses both the problems of ease of use, as well as effectiveness in construction in securement of sheet-like components together and in this respect, the present invention substantially fulfills this need.

SUMMARY OF THE INVENTION

In view of the foregoing disadvantages inherent in the known types of fastener structure now present in the prior art, the present invention provides a binding fastener assembly wherein the same utilizes spaced plates formed with apertures therethrough to receive fastener members directed in opposing orientations and coaxially aligned to secure the plates and intermediately position sheet-like members therebetween. As such, the general purpose of the present invention, which will be described subsequently in greater detail, is to provide a new and improved binding fastener assembly which has all the advantages of the prior art fastener organizations and none of the disadvantages.

To attain this, the present invention provides a fastener structure for use and securement of sheet stacks, wherein the fasteners each include a semi-cylindrical shank formed with engagement ribs in confronting relationship relative to securing pairs of the fasteners. The ribs each include a horizontal floor, and wherein the fasteners are in an axially aligned relationship relative to one another to effect securement of a sheet stack utilizing spaced binder plates to secure the stack together.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved binding fastener assembly which has all the advantages of the prior art fastener organizations and none of the disadvantages.

It is another object of the present invention to provide a new and improved binding fastener assembly which may be easily and efficiently manufactured and marketed.

It is a further object of the present invention to provide a new and improved binding fastener assembly which is of a durable and reliable construction.

An even further object of the present invention is to provide a new and improved binding fastener assembly which is susceptible of a low cost of manufacture with regard to both materials and labor, and which accordingly is then susceptible of low prices of sale to the consuming public, thereby making such binding fastener assemblies economically available to the buying public.

Still yet another object of the present invention is to provide a new and improved binding fastener assembly which provides in the apparatuses and methods of the prior art some of the advantages thereof, while simultaneously overcoming some of the disadvantages normally associated therewith.

Still another object of the present invention is to provide a new and improved binding fastener assembly wherein the same utilizes complementarily arranged engagement ribs in opposed orientations to secure sheet-like members therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
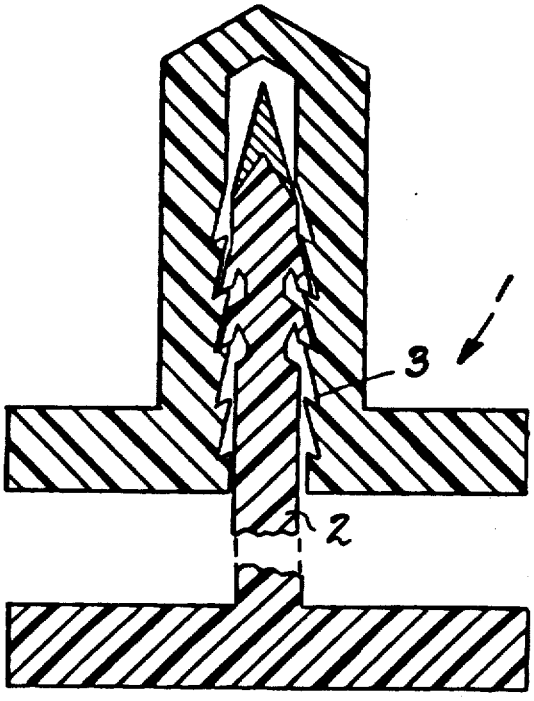
FIG. 1 is an orthographic cross-sectional illustration of a prior art fastener assembly.

With reference now to the drawings, and in particular to FIGS. 1 to 8 thereof, a new and improved binding fastener assembly embodying the principles and concepts of the present invention and generally designated by the reference numeral 10 will be described.

FIG. 1 is an orthographic cross-sectional illustration of a prior art fastener assembly 1, wherein a shank 2 includes serrated wing-like securement members cooperative with a socket 3 utilizing complementarily shaped ribs for securement of the plurality of elements together.

Figure 2:
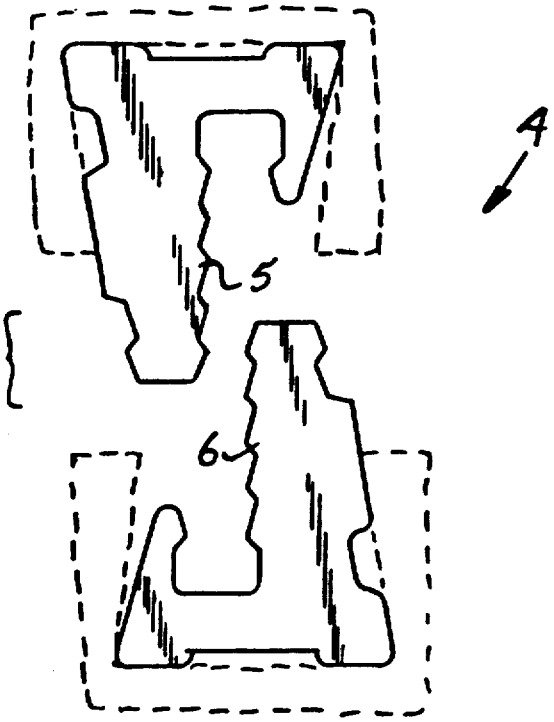
PRIOR ART FIG. 2
FIG. 2 is an orthographic side view, taken in elevation, of a further prior art example of a fastener assembly.
Figure 3:
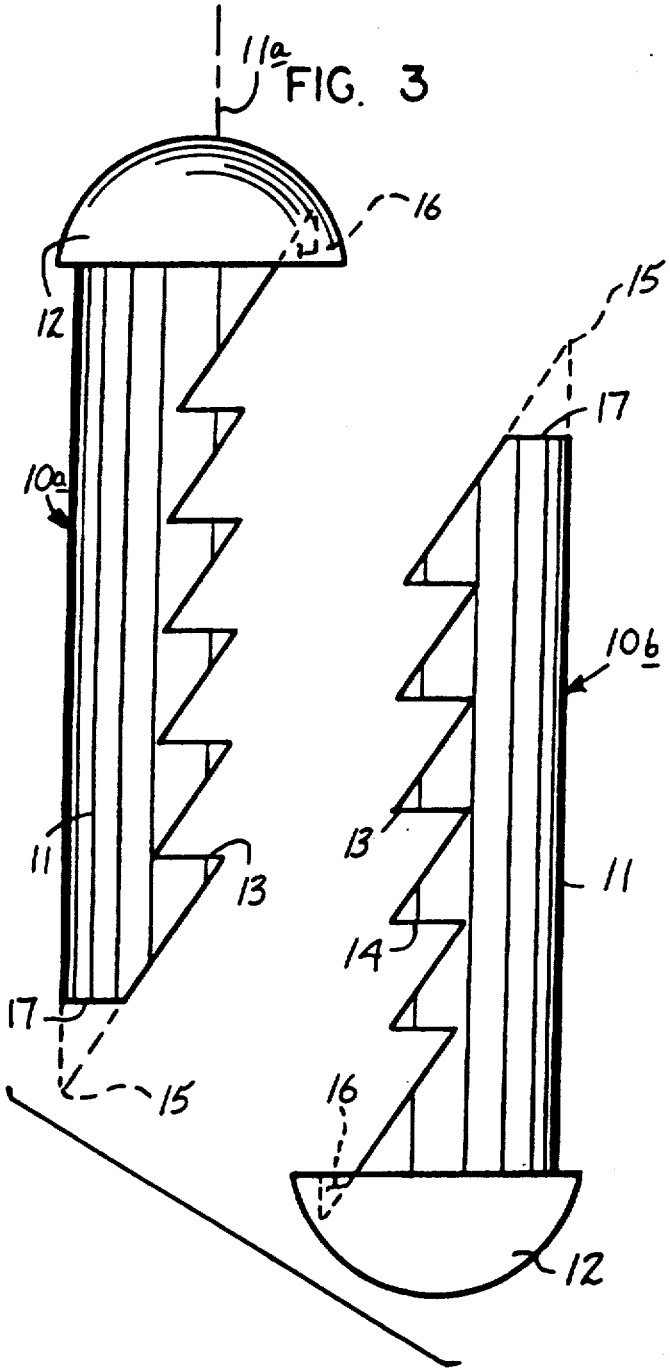
FIG. 3 is an orthographic side view, taken in elevation, of the first and second fasteners utilized by the instant invention.
Figure 4:
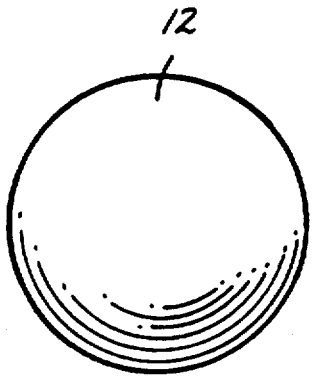
FIG. 4 is a top orthographic view of each fastener, as set forth in FIG. 3.
Figure 5:
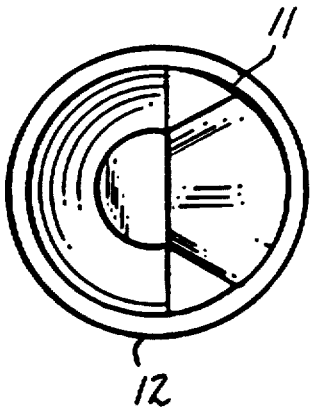
FIG. 5 is a bottom orthographic view of each fastener as set forth in FIG. 3.

FIG. 2 illustrates a further prior art assembly 4 with a plurality of generally "L" shaped structures utilizing complementarily arranged ribs 5 and 6 for reception and securement of the opposed sections together.

Figure 6:
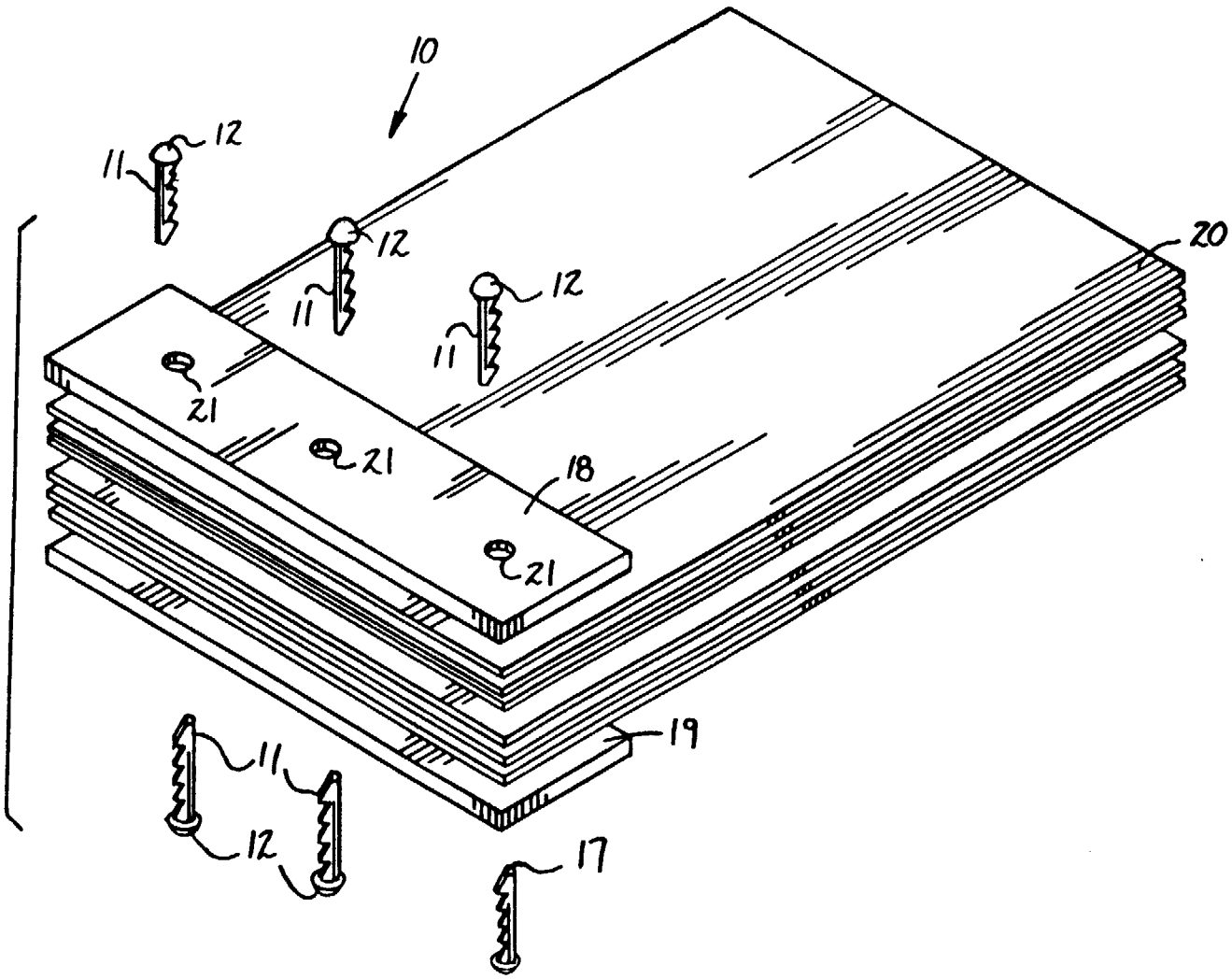
FIG. 6 is an isometric illustration, somewhat exploded, of the instant invention.
Figure 7:
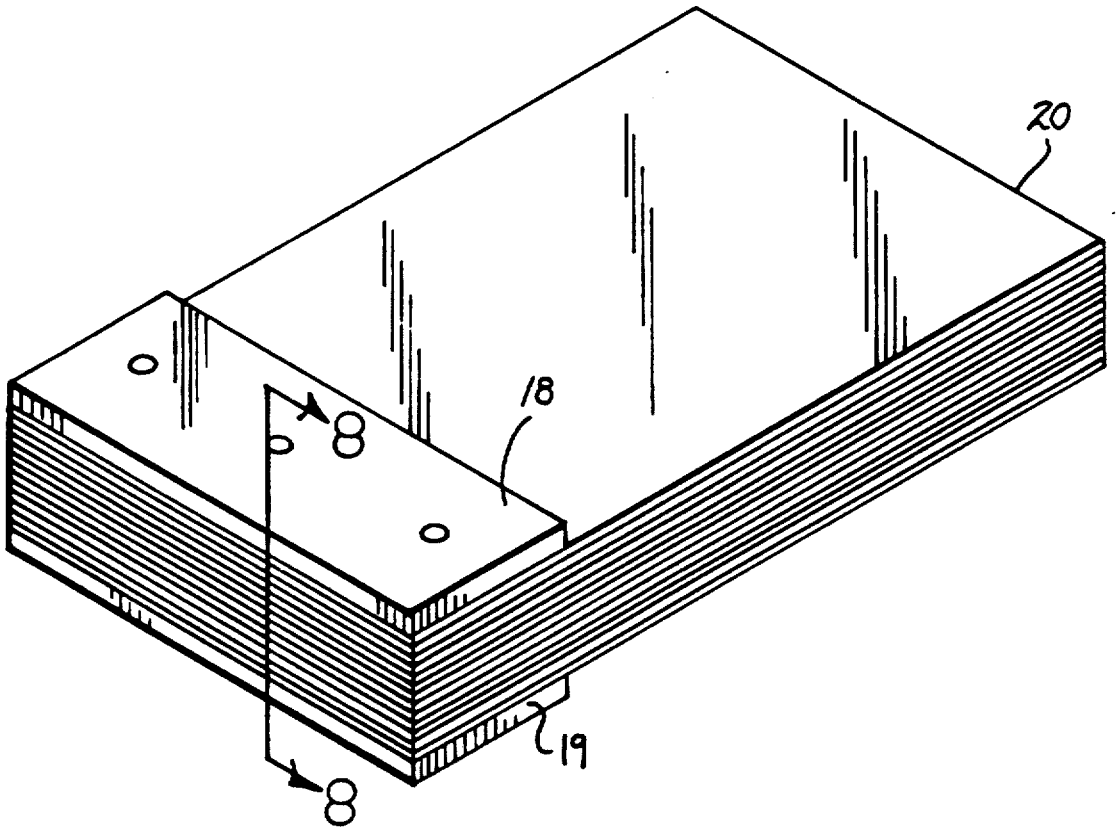
FIG. 7 is an isometric illustration of the organization in an assembled configuration.

More specifically, the binding fastener assembly of the instant invention essentially comprises the use of a first and second fastener 10*a* and 10*b* arranged in opposed orientations, wherein each fastener includes a semi-cylindrical shank 11 coaxially aligned and arranged orthogonally to a spherical head member 12 integrally attached to an upper terminal end of each semi-cylindrical shank 11. Each shank 11 includes a series of engagement ribs 13 directed radially towards the axis 11*a* defined by the shank 11 of each fastener, with each of the ribs 13 including a horizontal floor surface 14 arranged orthogonally relative to the axis 11*a*, and wherein each floor is equally spaced and parallel relative to one another of the ribs 13. If desired, in lieu of a blunt lower end surface 17, an optional pointed projection 15 may be utilized in cooperation with a semi-conical cavity 16 formed in each head member 12 to receive the pointed projection 15 to enable enhanced piercing of each shank 11 through a stack of flexible sheets 20, as illustrated in FIG. 6 for example.

Figure 8:
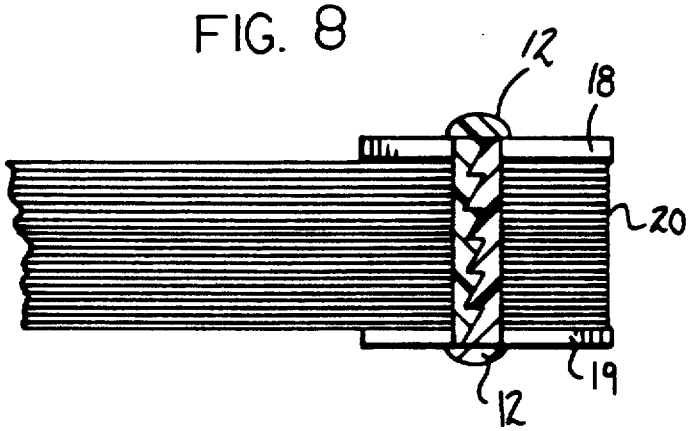
FIG. 8 is an orthographic view, taken along the lines 8—8 of FIG. 7, in the direction indicated by the arrows.

The organization further includes a top rigid plate 18 spaced from a bottom rigid plate 19. Each rigid plate includes a series of aligned apertures 21 to define upper and lower pairs of apertures, in a manner as illustrated in FIG. 8 for example. Each of the pairs of apertures receives a first and second fastener 10*a* and 10*b* therethrough to permit securement of the fasteners in coaxially aligned relationship relative to one another to secure the sheet stack 20 therebetween. Accordingly, a plurality of such pairs of fasteners are utilized in cooperation with the aligned apertures 20 of each of the pairs of apertures of the top and bottom plates 18 and 19. It should be further understood that the organization may be formed in a variety of sizes to accommodate openings within the sheet stack 20, and it is further submitted that the fasteners are formed of a relatively semi-rigid polymeric organization to accommodate a degree of flexure in association of the sheet stack together.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A binding fastener assembly comprising, in combination, a top and bottom plate, each top and bottom plate including a respective top and bottom series of apertures, each top aperture aligned with a bottom aperture to define a pair of apertures, and each pair of apertures including a plurality of fasteners directed therethrough for securement of a stack of sheets therebetween, and wherein the plurality of fasteners include a first fastener and a second fastener, the first fastener and the second fastener of identical configuration and arranged in an opposed orientation relative to one another, and wherein the plurality of fasteners are coaxially aligned relative to one another, and wherein each first and second fastener includes a respective coaxially aligned semi-cylindrical shank integrally and orthogonally mounted to a planar bottom surface of a semi-spherical head member, and each semi-cylindrical shank is defined by a shank axis, and each semi-cylindrical shank includes a series of engagement ribs radially directed to intersect each axis of each shank, and wherein the engagement ribs of each semi-cylindrical shank include a series of spaced parallel horizontal floor surfaces, the floor surfaces orthogonally arranged relative to the axis of each semi-cylindrical shank, and wherein the first and second fasteners are coaxially aligned relative to one another when assembled through respective pairs of apertures, and wherein each semi-cylindrical shank includes a pointed terminal end spaced from each semi-spherical head member, and each semi-spherical head member includes a semi-conical cavity to receive a pointed end from an opposed fastener when the first and second fasteners are in an assembled configuration.

* * * * *